US005169565A

United States Patent [19]

Son et al.

[11] Patent Number: 5,169,565

[45] Date of Patent: Dec. 8, 1992

[54] ANTI-DAZZLING AND ELECTROSTATIC CHARGE PREVENTIVE TRANSPARENT COATING MATERIAL, METHOD THEREOF AND VIDEO DISPLAY COATED THEREWITH

[75] Inventors: Changmin Son; Soomin Jeong, both of Kyunggi; Hunsoo Kim, Seoul, all of Rep. of Korea

[73] Assignee: Samsung Electronics, Kyunggi, Rep. of Korea

[21] Appl. No.: 536,783

[22] Filed: Jun. 12, 1990

[30] Foreign Application Priority Data

Mar. 31, 1990 [KR] Rep. of Korea ..... 90-4447

[51] Int. Cl.[5] ..... H01B 1/06

[52] U.S. Cl. ..... 252/518; 252/512

[58] Field of Search ..... 252/501.1, 512, 518; 524/910-912; 423/593; 106/47.4, 455

[56] References Cited

U.S. PATENT DOCUMENTS

| | | | |
|---|---|---|---|
| 4,409,134 | 10/1983 | Yamazaki | 252/501.1 |
| 4,421,677 | 12/1983 | Bianchin et al. | 252/501.1 |
| 4,639,329 | 1/1987 | Makishima et al. | 252/501.1 |
| 4,999,261 | 3/1991 | Perander et al. | 428/697 |
| 5,045,235 | 9/1991 | Ohara et al. | 252/501.1 |

*Primary Examiner*—Mark L. Bell
*Assistant Examiner*—Chris Gallo
*Attorney, Agent, or Firm*—Cushman, Darby & Cushman

[57] ABSTRACT

There is disclosed an anti-dazzling and electrostatic charge-preventive transparent coating material comprised of at least two kinds of conductive metallic compounds dissolved in an organic solvent and concentrated, the concentrate being added with water and catalyst to form a transparent solution containing fine particulates, ethyl silicate dissolved in another organic solvent, said transparent solution and the ethyl silicate solution being mixed together to cause hydration and polycondensation, thereby leading to the growth of particulate solid ingredient.

4 Claims, 3 Drawing Sheets

ANTI-DAZZLING AND ELECTROSTATIC CHARGE PREVENTIVE TRANSPARENT COATING MATERIAL, METHOD THEREOF AND VIDEO DISPLAY COATED THEREWITH

BACKGROUND OF THE INVENTION

1. Field of the Invention

The present invention concerns an anti-dazzling and electrostatic charge preventive transparent coating material, which is applied to the external surface of a video display or CRT to prevent dazzling and electrostatic charging.

Generally, the screen of a CRT or LCD is made of an insulating transparent material with a high surface resistance such as glass or reinforced plastic that accumulated, electrostatic charges, so that foreign materials such as dusts in the atmosphere are adhere to the screen surface, thereby deteriorating the visual quality. Moreover, the user may be subjected to an electrical shock. Additionally, if the LCD substrate is electrostatically charged, a misoperation may occur so that the segment not supplied with a driving voltage is driven.

Meanwhile, the surface of the screen is generally flat, and directly reflects the external light, so that it tends to make it difficult to distinctly view the images displayed on the screen. This tendency becomes more serious as the external light becomes stronger. In a place of high illumination, it is impossible to distinctly view images on the display having low brightness such as LCD and CRT. Hence, long time use of such a display causes fatigue the user's eyes to be.

Conventionally, in order to solve the external light reflecting problems as described above, a coating material mainly comprising a polymer containing silica is applied to the external surface of a video display by spraying, thereby roughening it so as to effect diffused reflection (refer to U.S. Pat. No. 3,689,312 and Japanese Patent Application Laid-Open No. sho 61-118,932), or alcohol or water solution mainly comprising silicate is applied to the external surface of a video display to form a continuous coating, which is mechanically rubbed, to produce a roughened effect reflection (Japanese Patent Application No. sho 63-138,724.

In addition, the electrostatic charge problem as described is solved by applying one of the following compositions to the external surface of the video display:

(A) mixture of fluorinated water repellant, chlorinated surfactant and alcohol (refer to Japanese Patent Application Laid-Open No. sho 60-156,783);

(B) silicon alcoholate to form a $SiO_2$ film, which is grounded (refer to Japanese Patent Application Laid-Open No. sho 63-158,733); and (C) alcoholic silicasol obtained by hydrolyzing a hydrolytic silicate, with an addition of metallic compound (refer to Japanese Patent Application Laid-Open No. sho 61-16452).

Further, if the electrostatic charge preventive coating material of the Japanese Patent Application Laid-Open No. sho 61-16452 is sprayed on the screen so as to roughen the external surface of a wide screen to effect diffused reflection, it is hard to uniformly roughen the whole surface of the screen. Moreover, since the electrostatic charge preventive effect of this coating material is caused by the moisture in the atmosphere absorbed by the material, it is hard to achieve in a low moisture environment, and when the water resistance of the material is considerably low.

In Japanese Patent Application Laid-Open No. sho 60-221937, there is disclosed a CRT whose external glass surface is roughened and coated with 1-valence alcohol or ester colloidal solution of $SiCl_4$. In this case, preparation of the roughened surface to effect diffused reflection and application of the coating material to prevent the electrostatic charge are performed separately from each other, thereby complicating the process, increasing the cost of the effect of diffused reflection and reducing the electrostatic charge prevention.

According to the method disclosed in Japanese Patent Application Laid-Open No. sho 63-160131, the solution of polyalky siloxane is applied to the external surface of the screen, subjected to condensation, so that the silanol(Si-OH) residing on the surface reacts with the moisture in the atmosphere creating conductivity, thereby preventing the electrostatic charge. In this case, the conductivity depends level of moisture in the atmosphere, and therefore, the desired reduction of the electrostatic charge would not be achieved in a dry environment.

Referring to P270-273, SID 89 DIGEST, in order to simultaneously achieve the effects of diffused reflection and electrostatic charge prevention, an electrostatic charge preventive composition is evenly applied to the external screen surface, which is again coated with a composition containing particulates to effect diffused reflection. In this case, the complicated process not only increases the production cost, but also requires particulate production and dispersion apparatuses in order to produce the particulate dispersed composition. Further, additives such as a dispersion agent is required, increasing the production cost of the composition.

SUMMARY OF THE INVENTION

The object of the present invention is to provide an anti-dazzling and electrostatic charge preventive transparent coating material, which is applied to the screen of a video display but by immersion or spin coating rather than spray coating, a method for preparation thereof, and a video display coated therewith.

According to the present invention, an anti-dazzling and electrostatic charge-preventive transparent coating material is comprised of at least two kinds of conductive metallic compounds dissolved in an organic solvent and concentrated. The concentrate is added to water, acid and base catalyst to form a transparent solution containing fine particulates of ethyl silicate dissolved in another organic solvent. Said transparent solution and the ethyl silicate solution are mixed to cause hydrolysis and polycondensation, thereby leading to the growth a of particulate solid ingredient.

The anti-dazzling and electrostatic charge preventive transparent coating material of the present invention is applied to the screen of a video display to form a conductive coating a fine particulate roughened surface.

According to another aspect of the present invention, there is provided a step method for preparing an anti-dazzling and electrostatic charge-preventive transparent coating material by dissolving at least two kinds of conductive metallic compounds in an organic solvent, heating and concentrating the dissolved, adding water to the concentrate to dilute, adding acid and base catalysts to the dilution to prepare a transparent solution containing fine particulates preparing ethyl silicate dissolved in another organic solvent, and mixing together said transparent solution and the ethyl silicate solution so hydrolysis and polycondensation to occur.

According to the present invention, the transparent solution and the ethyl silicate solution are mixed together to cause hydration and polycondensation, thereby leading the growth of particulate solid ingredient in the final product.

Due to the particulate solid ingredient, even if the inventive material is applied to the screen rather than spray coating by immersion or spin coating, it produces a good anti-dazzling effect.

The conductive metallic compounds may be selected from tin, antimony, and indium. At least two of these metallic compounds are mixed to effect a desired anti-dazzling and electrostatic charge prevention.

The organic solvent used for the present invention may be selected from alcohol, ketone and acetate, or a mixture of at least two of them.

The catalyst may be selected from chloric acid, nitric acid or ammonia water.

In the inventive transparent coating material, the added amount ethyl silicate is preferably of 1 to 20 percent by weight of % to the total composition.

If the amount is less than 1 percent, the strength of the coating is insufficient, while if the amount is greater than 20 percent, the higher viscosity prevents a good coating.

The added amount of the metallic compounds is preferably of 0.04 to 9 percent by weight of to the total composition. If the amount is less than 0.04, the conductivity is insufficient, while if the amount is greater than 9, the strength of the coating is reduced.

The added amount of acid or base catalyst is preferably 0.001 to 2.5 percent by weight of the total composition. The amount of the catalyst is an important factor for determining the size and amount of the particulates produced in the final product. If the percent by weight is too high, the number and size of the particulates are increased, thus impairing the transparency. On the other hand, if the percent by weight is too low, the number and size of the particulates are reduced, thereby impairing the anti-dazzling effect.

The content of the organic solvent to the total composition is preferably 70 to 98 percent of the total weight. If the amount is too high, the viscosity is lowered, while if it is too low, the viscosity is raised, thereby impairing the coating.

DETAILED DESCRIPTION OF THE INVENTION

Figure 1:
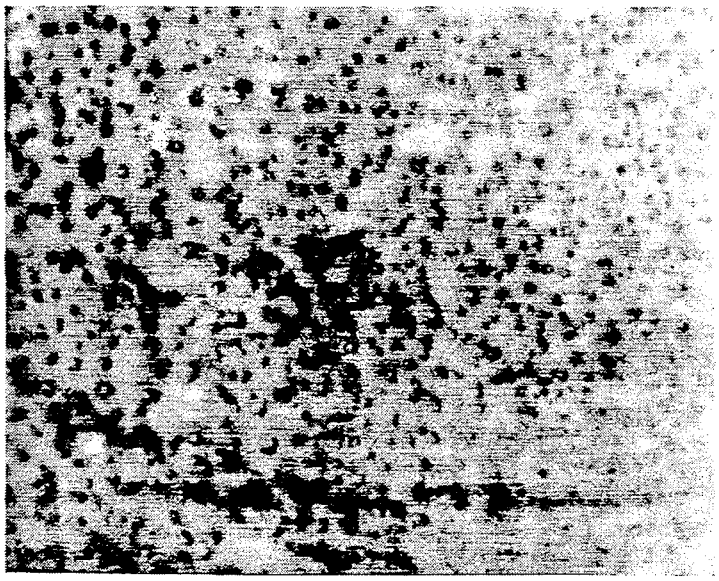
FIGS. 1 to 3 show microscopic photographs taken at a 200 to 400 times enlarged scale of a screen coated with the inventive coating materials by spin coating.

The process for prepairing a transparent coating material may be readily performed at a normal temperature and pressure. The inventive coating material is applied to the external screen surface of a video display such as a CRT by the conventional immersion or spin coating so as to form a conductive coating having fine particulate projections, thus making the screen simultaneously have the anti-dazzling and electrostatic charge preventive properties.

Further, if the screen coated with the inventive coating material is subjected to the conventional rubbing treatment, the particulates are easily removed from the coating, thus creating fine depressions on the coating surface, so that the screen has almost the same anti-dazzling property as the screen before the rubbing treatment.

Described hereinafter are specific examples of methods for preparing the inventive transparent coating material and a video display coated therewith and are not restrictive of the present invention.

EXAMPLE 1

90 g of ethyl silicate is dissolved in a solvent mixture of ethanol and isopropanol to obtain a total ethyl silicate solution amount of 860 ml.

Separately, 20 g of tin chloride hydrate($SnCl_4.nH_2O$) and 5 g of antimony chloride($SbCl_3$) are dissolved in ethanol to prepare a total of 50 ml of metallic compound solution. This solution is heated at 75° C. under normal pressure and concentrated until the total volume is reduced to 25 ml. The concentrate is added to water so the total volume is 50 ml. This in turn is combined with 0.7 ml of hydrochloric acid and 2 ml of ammonia water($NH_4OH$) as catalysts, thereby forming a transparent solution containing particulates.

The transparent solution is combined with the previously prepared ethyl silicate solution and subjected to hydrolysis and polycondensation, thus obtaining the desired transparent coating material.

EXAMPLE 2

85 g of ethyl silicate is dissolved in a solvent mixture of methanol and isopropanol to obtain an ethyl silicate solution with a total volume of 870 ml.

Separately, 8 g of indium chloride hydrate($InCl_3.nH_2O$) and 1 g of tin chloride hydrate($SnCl_4.nH_2O$) are dissolved in methanol to prepare a metallic compound solution with a total volume of 30 ml. This solution is heated at 75° C. under normal and pressure, concentrated until the total volume is reduced to 15 ml. The concentrate is added to water so the total volume is 30 ml. This in turn is combined with 0.8 ml of hydrochloric acid and 0.7 ml of ammonia water($NH_4OH$) as catalysts, thereby forming a transparent solution containing particulates.

The transparent solution is combined with the previously prepared ethyl silicate solution and subjected to hydrolysis and polycondensation, thus obtaining the desired transparent coating material.

EXAMPLE 3

50 g of ethyl silicate is dissolved in solvent mixture of methanol, isopropanol and ethanol so as to obtain ethyl silicate solution with a total volume of 420 ml.

Separately, 5 g of indium nitride hydrate($In(NO_3)_3.nH_2O$) and 0.9 g of tin chloride hydrate ($SnCl_4.nH_2O$) are dissolved in methanol to prepare a metallic compound solution with a total volume of 30 ml. This solution is heated at 80° C. under normal pressure and, concentrated until the total volume is reduced to 15 ml. The concentrate is added to water so the total volume is 30 ml. This in turn is combined with 3 ml of hydrochloric acid and 1.2 ml of ammonia water($NH_4OH$) as catalysts, thereby forming a transparent solution containing particulates.

The transparent solution is combined with the previously prepared ethyl silicate solution subjected to hydrolysis and polycondensation, thus obtaining the desired transparent coating material.

Figure 2:
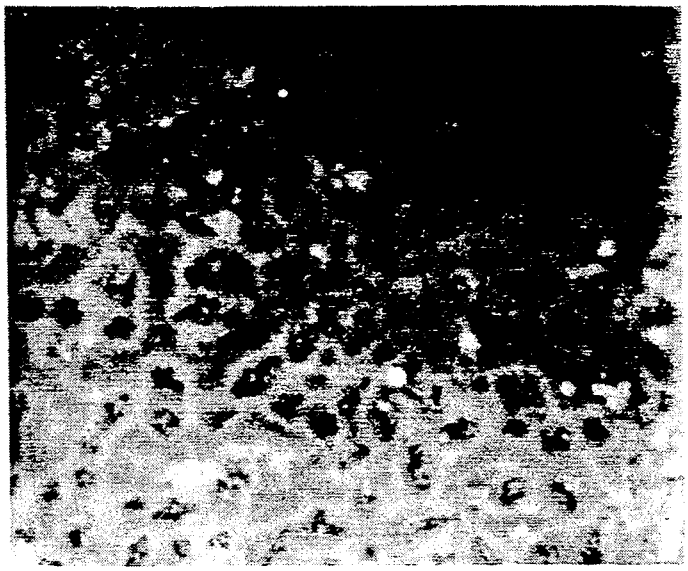
Figure 3:
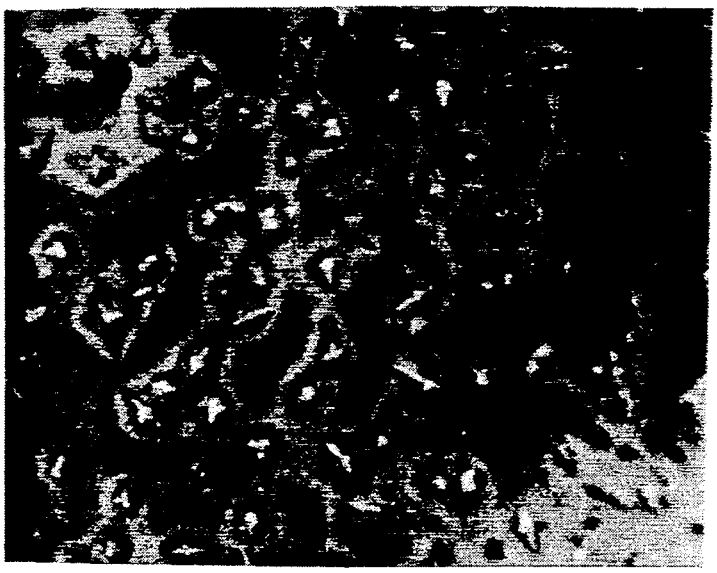

A transparent coating material obtained in the above examples 1 to 3 is applied to the glass screen by spin coating. This coating surface is microscopically photographed at 200 to 400 times enlarged scale, as shown in FIGS. 1 to 3. The electrical resistance of the coated surface has been measured at $1.0\times10^{9}$ to $8.5\times10^{10}$ ohm. ("Megaresta" of Japanese Shishido Electrostatic Ltd., with an applied voltage of 500 V, used for measuring).

Figure 4:
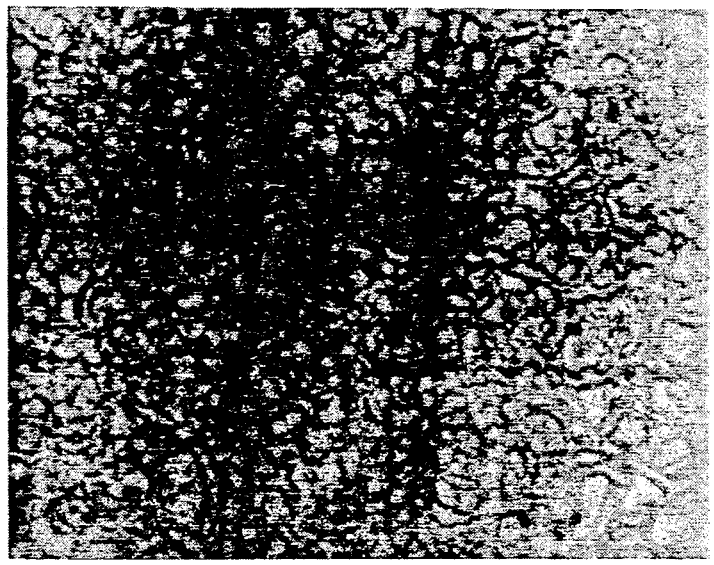
FIG. 4 shows a microscopic photograph taken at a 125 times enlarged scale of the screen coated with the prior art coating material by spray coating.

Meanwhile, in order to compare the inventive transparent coating material, the conventional conductive coating material disclosed in Japanese Patent Application Laid-Open No. sho 61-16452 is applied to the screen by spray coating, microscopically photographed at 125 times enlarged scale, as shown in FIG. 4. The electrical resistance of the coated surface has been measured at $8\times10^{9}$ to $5\times10^{11}$ ohm ("Megaresta" of Japanese Shishido Electrostatic Ltd., with an applied voltage of 500 V, used for measuring).

As illustrated by the enlarged photographs of FIGS. 1 to 4 and the values of the surface resistances, the inventive transparent coating material inherently contains solid particulates, so that even if it is applied to the screen by immersion or spin coating, the solid particulates form fine projections on the screen producing an excellent anti-dazzling property and good conductivity for preventing the electrostatic charge.

Meanwhile, the video display coated with the inventive coating material may be manufactured according to the conventional process as follows. Although the CRT is used as the video display in the example for descriptive convenience, other kinds of displays may be used.

The inventive transparent coating materials obtained by any method in Examples 1 to 3 is applied to the screen of the CRT by immersion or spin coating, and subjected to heat treatment at a temperature range of 80° to 490° C., and then cooled to room temperature.

Figure 5:
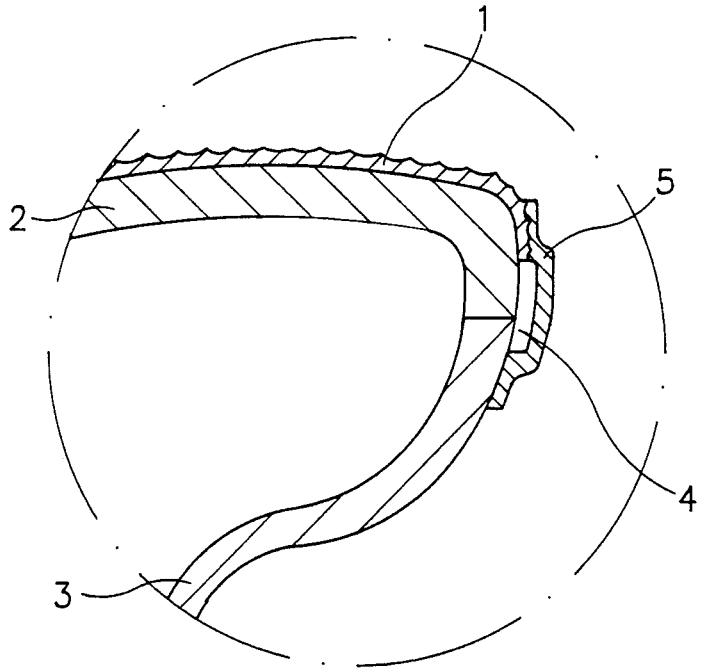
FIG. 5 illustrates a partial cross section of a CRT coated with the inventive coating materials.

In order that the CRT coated as described above has an adequate electrostatic charge preventive property, a graphite layer is deposited on coated layer 1 on panel 2, anti-explosion band 4 and funnel 3, and has aluminum or copper tape 5 attached thereon for electrical conduction, as shown in FIG. 5.

The anti-dazzling and electrostatic charge preventive screen surface of a CRT prepared according to the present invention has the particulates projected on the coated layer, as shown in FIG. 5, which particulates, if necessary, may be rubbed off the coated layer so as to form fine depressions thereon.

The particulates in the inventive transparent coating materials are very fine, and therefore, whether or not they are removed from the coated layer by rubbing does not affect impart a good anti-dazzling property to the screen.

Moreover, the inventive transparent coating material is readily synthesized without dispersing fine particulates of conductive metals or oxides as in the conventional composition, so that the production cost is reduced and the synthesizing process is extremely simplified.

What is claimed is:

1. An anti-dazzling and electrostatic charge-preventive transparent coating material comprising:

a) 1% to 20% by weight of ethyl silicate, b) 0.04% to 9% by weight of at least two different metal compounds, c) 0.001% to 2.5% by weight of at least one catalyst having an acid or hydroxyl base, d) 70% to 98% by weight of at least one organic solvent selected from a group consisting of alcohol, ketone, acetate, and e) a residual amount of water to make 100% by weight, said material being prepared by:

i. dissolving said at least two different metal compounds in said organic solvent and evaporating the resulting solution to attain a concentrated solution reduced in volume by one-half to one-third, ii. adding water and said catalyst to said solution thereby to obtain a transparent solution containing fine particulates, iii. dissolving ethyl silicate in said organic solvent to form an ethyl silicate solution, and iv. mixing together said transparent solution and said ethyl silicate solution to cause hydrolysis and polycondensation, thereby leading to the growth of a particulate solid mixture.

2. An anti-dazzling and electrostatic charge-preventive transparent coating material as claimed in claim 1, characterized by said conductive metal compounds being selected from the group consisting of tin chloride tin chloride hydrate; antimony chloride antimony chloride hydrate; indium chloride hydrate and indium nitrate hydrate.

3. An anti-dazzling and electrostatic charge-preventive transparent coating material as claimed in claim 1, characterized in that said organic solvent used in step a) and c) is selected from the group consisting of methanol, ethanol, propanol, isopropanol and buthanol; ketones including acetone, methyl ethyl ketone and methyl isobutyl ketone; and acetates including buthyl acetate and ethyl acetate.

4. An anti-dazzling and electrostatic charge-preventive transparent coating material as claimed in claim 1, characterized in said catalyst is selected from the group consisting of chloric acid, nitric acid, ammonia water and a mixture thereof.

* * * * *